US012378878B2

(12) United States Patent
Saihati et al.

(10) Patent No.: US 12,378,878 B2
(45) Date of Patent: Aug. 5, 2025

(54) METHOD AND SYSTEM FOR MANAGING DRILLING PARAMETERS BASED ON DOWNHOLE VIBRATIONS AND ARTIFICIAL INTELLIGENCE

(71) Applicant: SAUDI ARABIAN OIL COMPANY, Dhahran (SA)

(72) Inventors: Ahmed I. Saihati, Saihat (SA); Bader M. Otaibi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 316 days.

(21) Appl. No.: 17/708,379

(22) Filed: Mar. 30, 2022

(65) Prior Publication Data

US 2023/0313678 A1 Oct. 5, 2023

(51) Int. Cl.
*E21B 49/00* (2006.01)
*E21B 44/00* (2006.01)
*E21B 45/00* (2006.01)

(52) U.S. Cl.
CPC ..... *E21B 49/003* (2013.01); *E21B 44/00* (2013.01); *E21B 45/00* (2013.01); *E21B 2200/20* (2020.05)

(58) Field of Classification Search
CPC ..... E21B 49/003; E21B 44/00; E21B 45/00; E21B 2200/20; E21B 2200/22
See application file for complete search history.

(56) References Cited

U.S. PATENT DOCUMENTS 6,424,919 B1 7/2002 Moran et al.
6,732,052 B2 * 5/2004 Macdonald ..... E21B 44/005 702/6

(Continued)

FOREIGN PATENT DOCUMENTS

CA 2 770 232 C 6/2016
CN 111980688 A * 11/2020 ..... E21B 47/022

OTHER PUBLICATIONS

Abughaban, Mahmoud, and et al. "Optimization of drilling performance based on an intelligent drilling advisory system." In International Petroleum Technology Conference, p. D031S069R001. IPTC, 2019 (Year: 2019).*

(Continued)

*Primary Examiner* — Douglas Kay
(74) *Attorney, Agent, or Firm* — Osha Bergman Watanabe & Burton LLP

(57) ABSTRACT

A method may include obtaining drilling surface parameter data regarding one or more drilling parameters during a drilling operation for a wellbore. The method may further include obtaining geological data regarding one or more formations within a subsurface of the wellbore. The method may further include obtaining vibration data regarding various drilling operations for various wellbores. The method may further include determining a predicted vibration value of a bottomhole assembly in the drilling operation using a machine-learning model, the drilling surface parameter data, the geological data, the vibration data, and a rate of penetration (ROP) value regarding the bottomhole assembly. The method may further include determining an adjusted ROP value regarding the bottomhole assembly using the predicted vibration value and the ROP value. The method may further include transmitting a command to update the drilling operation based on the adjusted ROP value.

13 Claims, 9 Drawing Sheets

(56) References Cited

U.S. PATENT DOCUMENTS

| | | | | |
|---|---|---|---|---|
| 8,798,978 | B2 * | 8/2014 | Ertas | E21B 44/00 73/152.47 |
| 8,977,523 | B2 * | 3/2015 | Ertas | E21B 45/00 703/2 |
| 9,285,794 | B2 | 3/2016 | Wang et al. | |
| 9,598,947 | B2 | 3/2017 | Wang et al. | |
| 10,275,715 | B2 | 4/2019 | Laing et al. | |
| 11,428,099 | B2 * | 8/2022 | Al-Rubaii | E21B 49/005 |
| 2002/0120401 | A1 * | 8/2002 | Macdonald | E21B 44/005 702/6 |
| 2013/0299241 | A1 * | 11/2013 | Alberty | E21B 47/10 175/50 |
| 2015/0300151 | A1 | 10/2015 | Mohaghegh | |
| 2017/0183940 | A1 * | 6/2017 | Bailey | E21B 44/00 |
| 2017/0254163 | A1 * | 9/2017 | Ross | B01D 33/76 |
| 2020/0040719 | A1 * | 2/2020 | Maniar | E21B 41/00 |
| 2021/0140300 | A1 * | 5/2021 | Al-Rubaii | E21B 21/08 |
| 2021/0148213 | A1 | 5/2021 | Madasu et al. | |
| 2023/0279767 | A1 * | 9/2023 | Keller | E21B 45/00 175/40 |

OTHER PUBLICATIONS

Wang, Chao, and et al. "Downhole mud loss transient simulation and detection with downhole dual measurement points." Journal of Petroleum Science and Engineering 198 (2021): 108184 (Year: 2021).*

Esmaeili, Abdolali and et al. "ROP Modeling Using Neural Network and Drill String Vibration Data." Paper presented at the SPE Kuwait International Petroleum Conference and Exhibition, Kuwait City, Kuwait, Dec. 2012. doi: https://doi.org/10.2118/163330-MS (Year: 2012).*

Christian, Etaje Darlington. "Identifying the optimum zone for reducing drill string vibrations." In SPE Annual Technical Conference and Exhibition?, p. D023S099R010. SPE, 2017 (Year: 2017).*

Abbas, Ahmed K. et al., "Drilling Rate of Penetration Prediction of High-Angled Wells Using Artificial Neural Networks"; Journal of Energy Resources Technology; vol. 141, Issue 11, Article No. 112904; pp. 112904-1-112904-11; Nov. 2019 (11 pages).

Azim, Reda Abdel, "Application of artificial neural network in optimizing the drilling rate of penetration of western desert Egyptian wells"; SN Applied Sciences; vol. 2, Issue 7, Article No. 1177; Jun. 6, 2020 (13 pages).

* cited by examiner

METHOD AND SYSTEM FOR MANAGING DRILLING PARAMETERS BASED ON DOWNHOLE VIBRATIONS AND ARTIFICIAL INTELLIGENCE

BACKGROUND

During a drilling operation, downhole vibrations may cause drilling equipment to weaken and/or fail. For example, a drill bit may become worn from severe vibrations such that the bit loses its drilling efficiency. On the other hand, some components in a bottomhole assembly may partially or completely fail requiring the drilling operation to stop in order to remove the bottomhole assembly for repairing and/or replacing various drilling components. Thus, the degree of severity of downhole vibrations may have a significant impact on drilling performance in a drilling operation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining drilling surface parameter data regarding one or more drilling parameters during a drilling operation for a wellbore. The method further includes obtaining geological data regarding one or more formations within a subsurface of the wellbore. The method further includes obtaining vibration data regarding various drilling operations for various wellbores. The method further includes determining, by a computer processor, a predicted vibration value of a bottomhole assembly in the drilling operation using a machine-learning model, the drilling surface parameter data, the geological data, the vibration data, and a rate of penetration (ROP) value regarding the bottomhole assembly. The method further includes determining, by the computer processor, an adjusted ROP value regarding the bottomhole assembly using the predicted vibration value and the ROP value. The method further includes transmitting a command to update the drilling operation based on the adjusted ROP value.

In general, in one aspect, embodiments relate to a system that includes a drilling system that includes a bottomhole assembly that includes a drill string. The drilling system is coupled to a wellbore. The system further includes a control system coupled to the drilling system. The control system includes a computer processor, and the control system obtains drilling surface parameter data regarding one or more drilling parameters during a drilling operation for the wellbore. The control system obtains geological data regarding one or more formations within a subsurface of the wellbore. The control system obtains vibration data regarding one or more drilling operations for one or more wellbores. The control system determines a predicted vibration value of the bottomhole assembly in the drilling operation using a machine-learning model, the drilling surface parameter data, the geological data, the vibration data, and a rate of penetration (ROP) value regarding the bottomhole assembly. The control system determining an adjusted ROP value regarding the bottomhole assembly using the predicted vibration value and the ROP value. The control system transmits a command to update the drilling operation based on the adjusted ROP value.

In some embodiments, an ROP model is obtained that determines a predicted adjusted ROP value for a first section of a wellbore in the first drilling operation based on various inputs. The inputs may include a weight-on-bit value, a drilling fluid pump rate value, and an ROP value, where the ROP value corresponds to a second section of the wellbore that was drilling prior to drilling the first section of the wellbore. In some embodiments, loss event data are obtained from various wells. A machine-learning model may be trained using the loss event data, where the loss event data may correspond to one or more lost circulation events. In some embodiments, vibration data correspond to a vibration type selected from a group consisting of a lateral vibration, a torsional vibration, and an axial vibration of a bottomhole assembly. In some embodiments, vibration data correspond to a predicted vibration value that is determined by the machine-learning model at an earlier time than the predicted vibration value in the drilling operation. In some embodiments, vibration data is acquired from a wellbore using various downhole pressure sensors coupled to a drill string. where a drilling operation may be performed in the wellbore using a bottomhole assembly that does not include a downhole pressure sensor for detecting vibrations.

In some embodiments, a training dataset is obtained that includes drilling surface parameter data, geological data, vibration data, and ROP data from various drilling operations for various wells. An initial model may be obtained and updated using the training dataset and various machine-learning epochs to produce a trained model. The trained model may be the machine-learning model used in predicting vibration data or ROP data. In some embodiments, a machine-learning model is a linear regression model. In some embodiments, a machine-learning model is an artificial neural network that includes an input layer, various hidden layers, and an output layer. The input layer may obtain lateral vibrational data of a bottomhole assembly, drilling surface parameter data, and the geological data. The output layer may produce a predicted torsional vibrational value of the bottomhole assembly. In some embodiments, a user device obtains a predicted vibration value of a bottomhole assembly. The user device may present, on a display device, various adjusted ROP values associated with the predicted vibration value. The user device may obtain a user selection of the adjusted ROP values, where a command for implementing the adjusted ROP value corresponds to the user selection. In some embodiments, a user device is coupled to the control system, where the user device provides a graphical user interface for presenting various predicted ROP values for a drilling operation. An adjusted ROP value may correspond to a user selection that is obtained from a user using the user device. In some embodiments, a mud pump system is coupled to a control system and a wellbore, where the mud pump system supplies drilling fluid to the wellbore. The control system may transmit a command to the mud pump system that produces an adjusted mud pump rate based on an adjusted ROP value.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for managing the rate of penetration (ROP) of a drilling operation based on predicting the amount and severity of downhole vibrations. In some embodiments, for example, machine learning is used to optimize rate of penetration (ROP) in a drilling operation by predicting downhole vibrations (e.g., without using downhole sensors) and predicting ROP values based on various combinations of drilling parameters. Where downhole vibrations may result in drill string failures, for example, selecting a particular ROP value that minimizes vibrations may prevent delays in drilling operations (such as eliminating the need for a fishing operation in response to a failed drill bit). Thus, various drilling surface parameters may be controlled to produce a corresponding combination of drilling parameters that enhance the rate of penetration while mitigating or reducing downhole vibrations.

Figure 1:
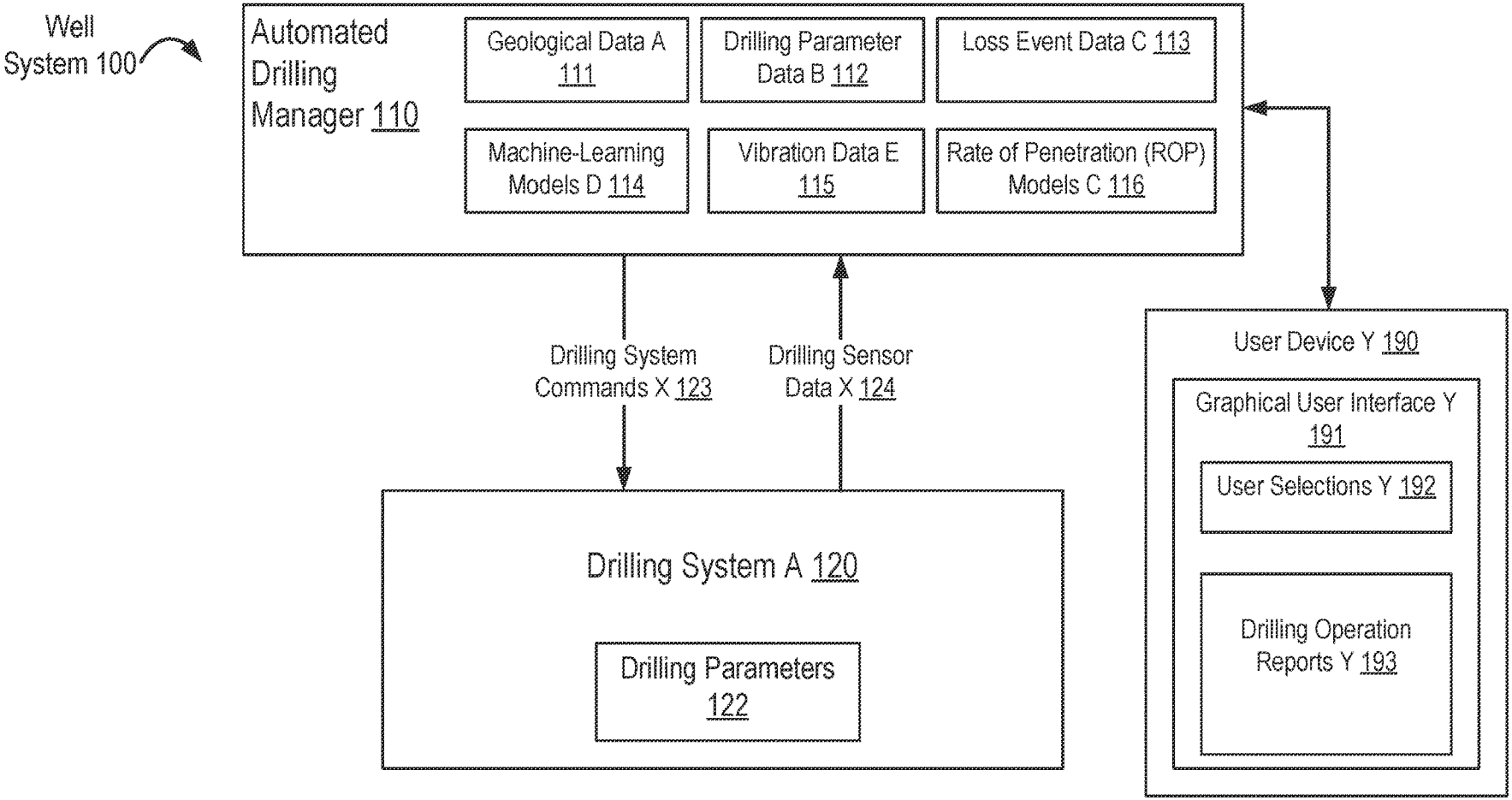
FIGS. 1 and 2 show systems in accordance with one or more embodiments.

Turning to FIG. 1, FIG. 1 shows a schematic diagram in accordance with one or more embodiments. As shown in FIG. 1, FIG. 1 illustrates a well system (100) that may include an automated drilling manager (e.g., automated drilling manager (110)) coupled to one or more user devices (e.g., user device Y (190)), a drilling system (e.g., drilling system A (120)), a mud pump system (not shown), an automated material transfer system (not shown), an automated mud property system (not shown), and various drilling fluid processing components. For example, drilling fluid processing equipment may include one or more feeders, one or more control valves, one or more mixing tanks, and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system.

In some embodiments, an automated drilling manager includes hardware and/or software with functionality to optimize one or more rate of penetration (ROP) values of a drill string and various vibration levels in a drilling system. For example, drilling operators may reduce the overall cost of the drilling operation by optimizing ROP values, drilling vibrations, and the mechanical specific energy (MSE) that is used for drilling. In particular, downhole vibrations may result from the interaction of a drill string with the wellbore and consequently impact the rate of penetration of a drilling operation. Downhole drilling vibration measurements may be classified as real-time vibration measurements (i.e., vibration measurements recorded at periodic time intervals and transmitted to well surface equipment using downhole telemetry) and memory device measurements (i.e., vibration measurements that record downhole vibrations during a drilling operation and are later retrieved at the well surface for further analysis).

With respect to drilling systems, drilling fluid may circulate through a drill string and through a wellbore. In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters (122)) such as drill pipe rotary speed (RPM), pipe eccentricity (i.e., axial location of the drill pipe), hole inclination angle, and rate of penetration (ROP). Likewise, used drilling fluid from a wellbore may be passed through a solid removal system prior to entering a mixing tank or being sent to a mud pump system. More specifically, a solid removal system may include equipment and other hardware for removing particular solids, such as drill cuttings and coarse aggregates, from used drilling fluid in order to recycle drilling fluid. For more information on drilling systems, see FIG. 2 and the accompanying description below.

With respect to mud pump systems, a mud pump system may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore, e.g., to clean hole cuttings from the wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

In some embodiments, an automated drilling manager transmits one or more commands (e.g., drilling system commands X (123)) to various control systems in a well system (e.g., drilling system A (120)) in order to produce drilling operations with specific drilling parameters, such as a specific rate of penetration value. For example, drilling parameters may include specific drilling fluid properties, such as predetermined density values or mud velocity values of a drilling fluid. Likewise, drilling parameters data (e.g., drilling parameter data B (112)) may also include drilling surface parameter data, such as a specific weight-on-bit, rotary speed values, and mud pumping rates. Commands may include data messages transmitted over one or more network protocols using a network interface, such as through wireless data packets. Likewise, a command may also be a control signal, such as an analog electrical signal, that triggers one or more operations in a particular control system (e.g., drilling system A (120)).

Furthermore, an automated drilling manager may monitor various drilling fluid properties and drilling parameters in real-time. For example, drilling fluid properties may be monitored using one or more mud property sensors. Likewise, drilling parameters may be modified in real-time based on sensor data (e.g., drilling sensor data X (124)) from downhole sensors, drilling sensors, etc. In some embodiments, for example, the automated drilling manager modifies drilling parameters at predetermined intervals until user-defined properties are achieved by the well system (100). The user-defined properties may correspond to a selection by a user device (e.g., user selection Y (192) obtained by user device Y (190) using a graphical user interface Y (191)). For example, an automated drilling manager may be coupled to a user device e.g., over a well network, or remotely (e.g., through a remote connection using Internet access or a wireless connection at a well site). Based on real-time updates received for a current drilling operation, a user and/or the automated drilling manager may modify previously-selected drilling parameters, e.g., in response to changes in a drill bit while drilling or changes in drilling fluid within the wellbore.

Keeping with FIG. 1, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager (110) and/or the user device Y (190) may include a computer system that is similar to the computer system (702) described below with regard to FIG. 7 and the accompanying description.

In some embodiments, an automated drilling manager collects loss event data (e.g., loss event data C (113)) regarding one or more lost circulation events from one or more wellbores. During some well operations, a lost circulation event may occur that results in a partial or complete loss of drilling fluid into a formation. For example, a lost circulation event may be brought on by natural causes or induced causes within the formation. Natural causes may include naturally-occurring fractures or caverns adjacent to a wellbore as well as unconsolidated zones. Induced causes may include a situation when a hydrostatic fluid pressure exceeds a fracture gradient of the formation resulting in a fracture receiving fluid rather than resisting the fluid. When drilling into highly fractured formations, for example, severe fluid losses may be encountered that pose serious threats to drilling operations. Fluid losses may lead to various risks such as high costs of replacing drilling fluid during the drilling operation, formation damage left behind by lost circulation treatments, and even a possible loss of hydrostatic pressure that can cause an influx of gas or fluid, e.g., resulting in a well blowout.

With respect to drilling operations, various types of lost circulation materials (LCMs) may be used in a lost circulation treatment to prevent or reduce drilling fluids from being lost inside downhole formations. LCM examples may include fibrous materials (e.g., cedar bark, shredded cane stalks, mineral fiber, and hair), flaky materials (e.g., mica flakes, pieces of plastic, and cellophane sheeting) or granular materials (e.g., ground and sized materials such as limestone, marble, wood, nut hulls, Formica, corncobs, and cotton hulls). A fibrous LCM may include long, slender and flexible substances that are insoluble and inert, where the fibrous material may assist in retarding drilling fluid loss into fractures or highly permeable zones. A flaky LCM may be thin and flat in shape with a large surface area in order to seal off fluid loss zones in a wellbore and help stop lost circulation. A granular LCM may be chunky in shape with a range of particle sizes. LCMs may also include one or more bridging agents that may include solids added to a drilling fluid to bridge across a pore throat or fractures of an exposed rock thereby producing a filter cake to prevent drilling fluid loss or excessive filtration. Example bridging agents may include removable-common products include calcium carbonate (acid-soluble), suspended salt (water-soluble) or oil-soluble resins. In some embodiments, granular materials, flaky materials, and/or fibrous materials are combined into an LCM pill and pumped into a wellbore next to a zone experiencing fluid loss to seal the formation. Different types of LCM may have different costs. For example, bentonite may have a lower price than medium-grade mica or nut plug circulation materials.

Figure 2:
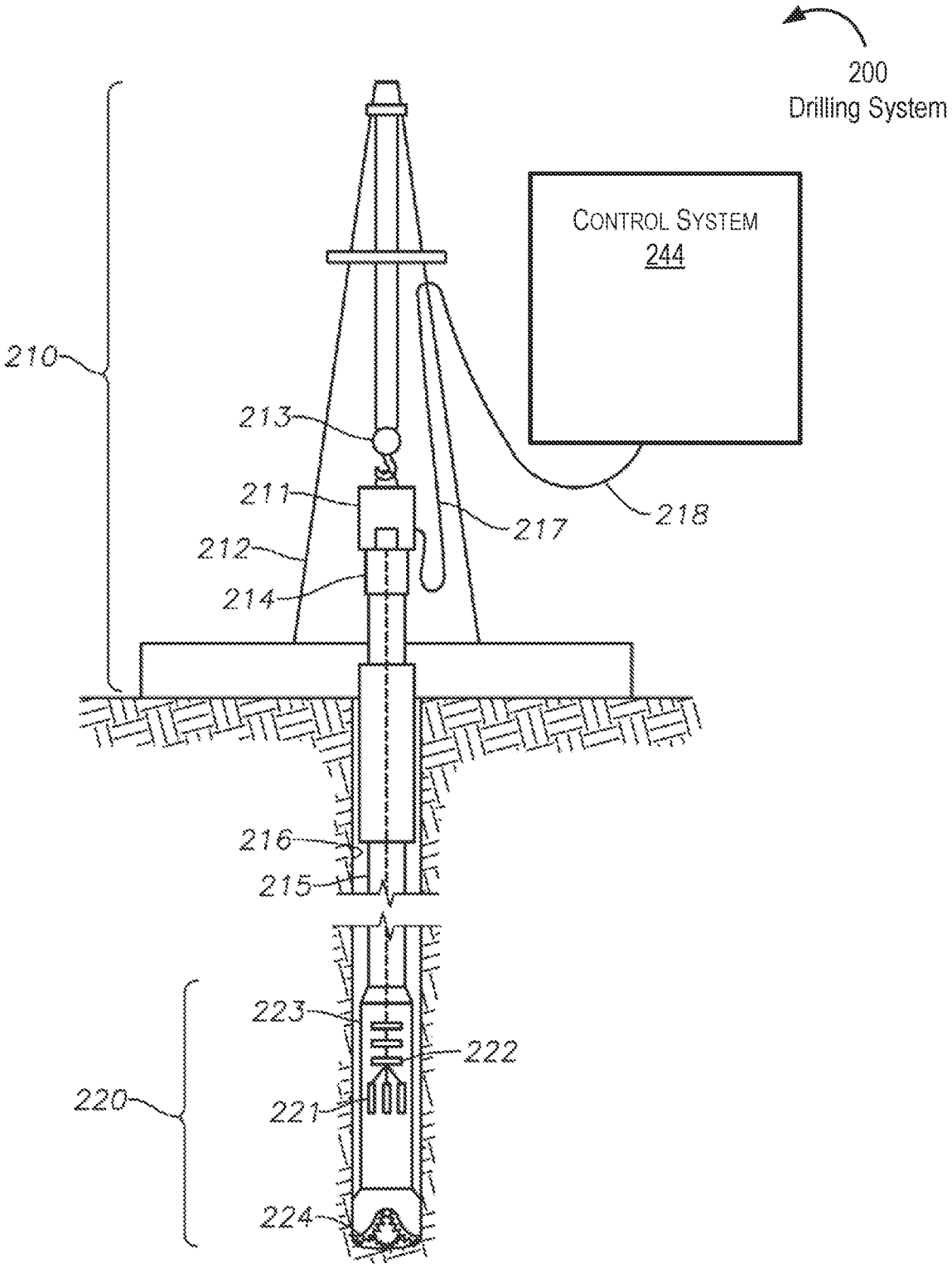

Turning to FIG. 2, FIG. 2 illustrates a system in accordance with one or more embodiments. As shown in FIG. 2, a drilling system (200) may include a top drive drill rig (210) arranged around the setup of a drill bit logging tool (220). A top drive drill rig (210) may include a top drive (211) that may be suspended in a derrick (212) by a travelling block (213). In the center of the top drive (211), a drive shaft (214) may be coupled to a top pipe of a drill string (215), for example, by threads. The top drive (211) may rotate the drive shaft (214), so that the drill string (215) and a drill bit logging tool (220) cut the rock at the bottom of a wellbore (216). A power cable (217) supplying electric power to the top drive (211) may be protected inside one or more service loops (218) coupled to a control system (244). As such, drilling fluid may be pumped into the wellbore (216) using the drive shaft (214) and/or the drill string (215). Likewise, the drilling system may also include a mud pump, a mud line, mud pits, a mud return, and other components related to the circulation or recirculation of drilling fluid within the wellbore (216). The control system (244) may be similar to various control systems described above in FIG. 1 and the accompanying description, such as the automated drilling manager (110).

In some embodiments, the drilling system (200) includes a bottomhole assembly (BHA). The bottomhole assembly may refer to a lower portion of the drill string (215) that includes a drill bit (224), bit sub (i.e., a substitute adapter), and a drill collar. The bottomhole assembly may also include a mud motor, stabilizers, heavy-weight drillpipe, jarring devices ("jars"), crossovers for various threadforms, directional drilling and measuring equipment, measurements-while-drilling tools, logging-while-drilling tools and other specialized devices. The bottomhole assembly may produce force for the drill bit to break rock and provide the drilling system with directional control of a wellbore. Different types of bottomhole assemblies may be used, such as a rotary assembly, a fulcrum assembly, and a pendulum assembly.

Moreover, when completing a well, casing may be inserted into the wellbore (216). The sides of the wellbore (216) may require support, and thus the casing may be used for supporting the sides of the wellbore (216). As such, a space between the casing and the untreated sides of the wellbore (216) may be cemented to hold the casing in place. The cement may be forced through a lower end of the casing and into an annulus between the casing and a wall of the wellbore (216). More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

As further shown in FIG. 2, sensors (221) may be included in a sensor assembly (223), which is positioned adjacent to a drill bit (224) and coupled to the drill string (215). Sensors (221) may also be coupled to a processor assembly that includes a processor, memory, and an analog-to-digital converter (222) for processing sensor measurements. For example, the sensors (221) may include acoustic sensors, such as accelerometers, measurement microphones, contact microphones, and hydrophones. Likewise, the sensors (221) may include other types of sensors, such as transmitters and receivers to measure resistivity, gamma ray detectors, etc. The sensors (221) may include hardware and/or software for generating different types of well logs (such as acoustic logs or density logs) that may provide well data about a wellbore, including porosity of wellbore sections, gas saturation, bed boundaries in a geologic formation, fractures in the wellbore or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (200) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The control system (244) may be coupled to the sensor assembly (223) in order to perform various program functions for up-down steering and left-right steering of the drill bit (224) through the wellbore (216). More specifically, the control system (244) may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Geosteering may be used to position the drill bit (224) or drill string (215) relative to a boundary between different subsurface layers (e.g., overlying, underlying, and lateral layers of a pay zone) during drilling operations. In particular, measuring rock properties during drilling may provide the drilling system (200) with the ability to steer the drill bit (224) in the direction of desired hydrocarbon concentrations. As such, a geosteering system may use various sensors located inside or adjacent to the drill string (215) to determine different rock formations within a well path. In some geosteering systems, drilling tools may use resistivity or acoustic measurements to guide the drill bit (224) during horizontal or lateral drilling.

Returning to FIG. 1, a user device (e.g., user device Y (190) may provide a graphical user interface (e.g., graphical user interface Y (191)) for communicating with an automated drilling manager, e.g., to monitor drilling operations and drilling fluid operations or make drilling adjustments, such as changing ROP values and other drilling parameters. For example, a user device may be a personal computer, a human-machine interface, a smartphone, or another type of computer device for presenting information and obtaining user inputs in regard to the presented information. Likewise, the user device may obtain various user selections (e.g., user selections Y (192)) in regard to drilling operations, such as based on real-time changes to drilling costs for a wellbore. Likewise, the user device may display various reports that may include charts as well as other arrangements of well data (e.g., drilling operation reports Y (193)).

In some embodiments, an automated drilling manager includes hardware and/or software with functionality for generating and/or updating one or more machine-learning models (e.g., machine-learning models D (114)) to predict downhole vibrations or optimized rate of penetration values. For example, a model for predicting downhole vibrations may correspond to one or more types of machine-learning models. Examples of machine-learning models may include linear regression models and artificial neural networks, such as convolutional neural networks, deep neural networks, and recurrent neural networks. For example, a linear regression model may perform a model fit of a relationship between a scalar response and one or more explanatory variables. The linear regression model may perform a simple linear regression or a multivariate linear regression based on multiple correlated dependent variables are predicted. Machine-learning models may also include support vector machines, decision trees, inductive learning models, deductive learning models, supervised learning models, unsupervised learning models, reinforcement learning models, etc. In a deep neural network, for example, a layer of neurons may be trained on a predetermined list of features based on the previous network layer's output. Thus, as data progresses through the deep neural network, more complex features may be identified within the data by neurons in later layers.

In some embodiments, two or more different types of machine-learning models are integrated into a single machine-learning architecture, e.g., a machine-learning model may include support vector machines and neural networks. In some embodiments, an automated drilling manager may generate augmented data or synthetic data to produce a large amount of interpreted data for training a particular model. Likewise, an automated drilling manager may obtain a variety of loss event data (e.g., loss event data C (113)), drilling surface parameter data (e.g., drilling parameter data B (112)), geological data (e.g., geological data A (111)), vibration data (e.g., vibration data E (115)), and physical well site data for validating an ROP model or a downhole vibration model.

In some embodiments, various types of machine learning algorithms may be used to train the model, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model.

With respect to artificial neural networks, for example, an artificial neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the artificial neural network. Likewise, these weighted data inputs may be summed such that this sum is communicated through a neuron's activation function to other hidden layers within the artificial neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of temperature values from an inlet to an outlet), with the output of the recurrent neural network being dependent on past computations. As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments disclosed herein are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc. With regard to LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, an automated drilling manager uses one or more ensemble learning methods in connection to one or more ROP models (e.g., ROP models C (116)) and/or vibration models. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

While FIGS. 1 and 2 shows various configurations of components, other configurations may be used without departing from the scope of the disclosure. For example, various components in FIGS. 1 and 2 may be combined to create a single component. As another example, the functionality performed by a single component may be performed by two or more components.

Figure 3:
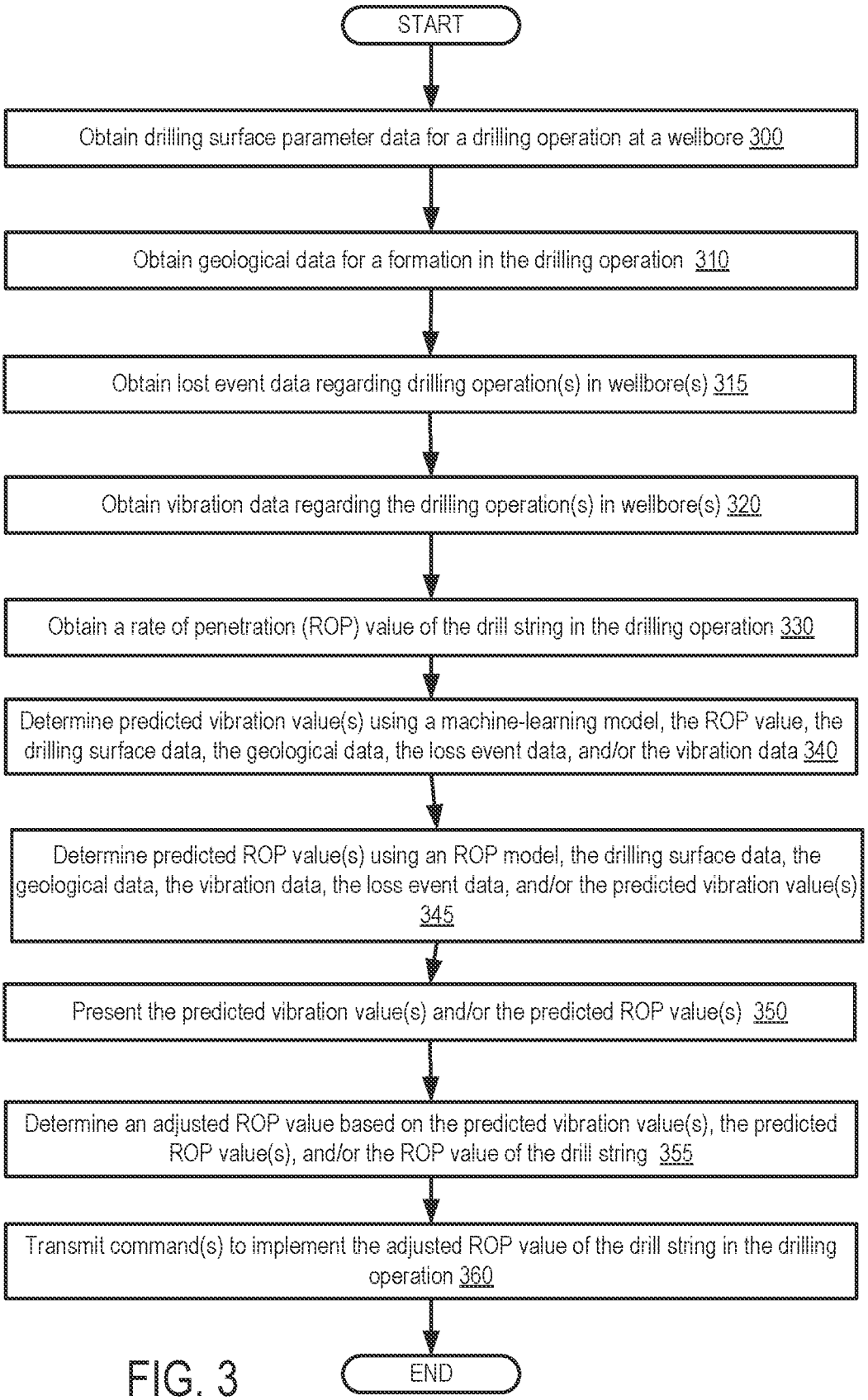
FIG. 3 shows a flowchart in accordance with one or more embodiments.

Turning to FIG. 3, FIG. 3 shows a flowchart in accordance with one or more embodiments. Specifically, FIG. 3 describes a general method for predicting vibration data and/or optimized ROP data using machine learning. One or more blocks in FIG. 3 may be performed by one or more components (e.g., automated drilling manager (110)) as described in FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 300, drilling surface parameter data are obtained for a drilling operation at a wellbore in accordance with one or more embodiments. In some embodiments, drilling surface parameters include weight-on bit (WOB), rotary speed (RS, such as measured in rotations per minute (RPM)), and mud pumping rate (Q). For example, drilling surface parameter data may be acquired from real-time transmitter sensors in a drilling system or other well system. Drilling surface parameter data may also be associated with a particular depth or depth interval in a wellbore. Other well attributes may be associated with drilling surface parameter data, such as a specific oil field.

In Block 310, geological data are obtained for one or more formations in a drilling operation in accordance with one or more embodiments. In some embodiments, an automated drilling manager obtains daily drilling operational reports. From a daily drilling operation report, a user or an automated drilling manager may identify one or more formations that are being drilled. Thus, a section of a wellbore may be labeled according to a particular formation or formation type.

In Block 315, loss event data are obtained regarding one or more drilling operations for one or more wellbores in accordance with one or more embodiments. When drilling through a weak formation or naturally fractured formation, for example, drilling fluid may be lost into a subsurface formation. This loss may result in a drop of the drilling fluid column in the wellbore and increase the severity of downhole vibrations because there may not be enough drilling fluid to support various drilling tools. Thus, loss event data may provide a loss classification of a particular section of a wellbore. In some embodiments, for example, loss event data may assign a complete loss where no return of the drilling fluid to the well's surface occurs, a partial loss where only a portion of the drilling fluid is returned to the well's surface, or an event where no drilling fluid losses occur. As such, loss event data may be associated with specific vibration levels, geological formations, and drilling surface parameters.

In some embodiments, sensor data from downhole sensors are assigned a loss event data value, e.g., corresponding to a complete loss, a partial loss, or no loss of drilling fluid. Moreover, loss event data may be obtained from daily operational reports. Likewise, loss event data may be collected using flow-out sensor readings installed at a well site to indicate whether any drilling fluid losses or a lost circulation event have occurred and to what degree. Accordingly, loss event data may describe whether a lost circulation event has occurred and/or the severity of the lost circulation event. Moreover, downhole vibrations may worsen in response to lost circulation events and due to the severity of the events.

In Block 320, vibration data are obtained regarding one or more drilling operations in one or more wellbores in accordance with one or more embodiments. For example, real-time downhole vibration measurements may be acquired from downhole sensors during one or more previous drilling operations. Vibration data may describe lateral vibrations, torsional vibrations, and/or axial vibrations with respect to a drill string that is performing a drilling operation. Vibration data may corresponds to pressure data and other sensor data, but may also correspond to various vibration risk values. For example, vibration data may identify a particular risk level that a lateral vibration or torsional vibration will disrupt a drilling component (e.g., the drill string) in a drilling operation. In some embodiments, vibration data is historical downhole vibration data acquired from past wells. On the other hand, vibration data may also be predicted vibration data, e.g., from a machine-learning model.

In Block 330, a rate of penetration (ROP) value is obtained of a drill string in a drilling operation in accordance with one or more embodiments.

In Block 340, one or more predicted vibration values are determined using a machine-learning model, an ROP value, drilling surface parameter data, geological data, loss event data, and/or vibration data in accordance with one or more embodiments. In some embodiments, for example, a machine-learning model is trained to determine predicted downhole vibrations, such as lateral vibrations, torsional vibrations, and/or axial vibrations (e.g., a machine-learning model may output two or more types of predicted downhole vibrations for a drilling operation). Various input features may be used with a machine-learning model, such as drilling surface parameter data, geological data (e.g., which type of formation is being drilled), loss event data, and vibration data. In some embodiments, the training dataset for an initial model is from a nearby well in the same oil field and/or the same section of a wellbore in a similar drilling operation. Thus, the initial model may be trained using vibration data, loss event data, and other data for a similar well in a similar geological formation.

Furthermore, a machine-learning model may be trained to predict vibration data. To train a machine-learning model to predict lateral vibration risk, for example, actual lateral vibration risk of the previous record at time (t−1) in a drilling operation may be added as an input. By learning from past experience, a machine-learning model may be fitted to predict the lateral vibration risk. On the other hand, two inputs may be added to predict torsional vibration data, i.e., the input features may include actual torsional vibration risk of the previous record at time (t−1) and the prediction of the lateral vibration risk from the previous step. The predicted lateral vibration risk may be added because of its relationship with the torsional vibration risk in practice. Then the machine-learning model may be fitted to predict the torsional risk.

In some embodiments, a machine-learning model is trained using multiple epochs. For example, an epoch may be an iteration of a model through a portion or all of a training dataset. As such, a single machine-learning epoch may correspond to a specific batch of training data, where the training data is divided into multiple batches for multiple epochs. Thus, a machine-learning model may be trained iteratively using epochs until the model achieves a predetermined level of prediction accuracy. Thus, better training of a model may lead to better predictions by a trained model.

After training, a machine-learning model may be used to predict downhole vibrations in real time during drilling operations without downhole sensors. The following explains how it can be used for real time application. For example, drilling surface parameter data and geological data for a new well may be fed into the machine-learning model once to simulate a real-time environment. A previous predicted lateral vibration data at time (t−1) may be used as an input variable to predict the lateral vibration data at time (t). Similarly, the previous predicted torsional vibration data may be used as an input variable to predict the torsional vibration data.

Furthermore, a machine-learning model may obtain an actual lateral vibration risk value from a previous time record (t−1) in an ongoing drilling operation. Thus, a particular type of vibration data may be an input feature to predicting the same type of vibration or a different vibration type in a real-time drilling operation. For example, an actual torsional vibration risk value and a predicted lateral vibration risk value from a previous time record (t−1) may be input to a machine-learning model to determine a predicted lateral vibration risk.

In some embodiments, vibration data is predicted using a logistic regression model. For example, a logistic regression model may not require huge computation resources when deployed at a well site. However, other types of machine-learning models are contemplated, such as deep neural networks.

Figure 4A:
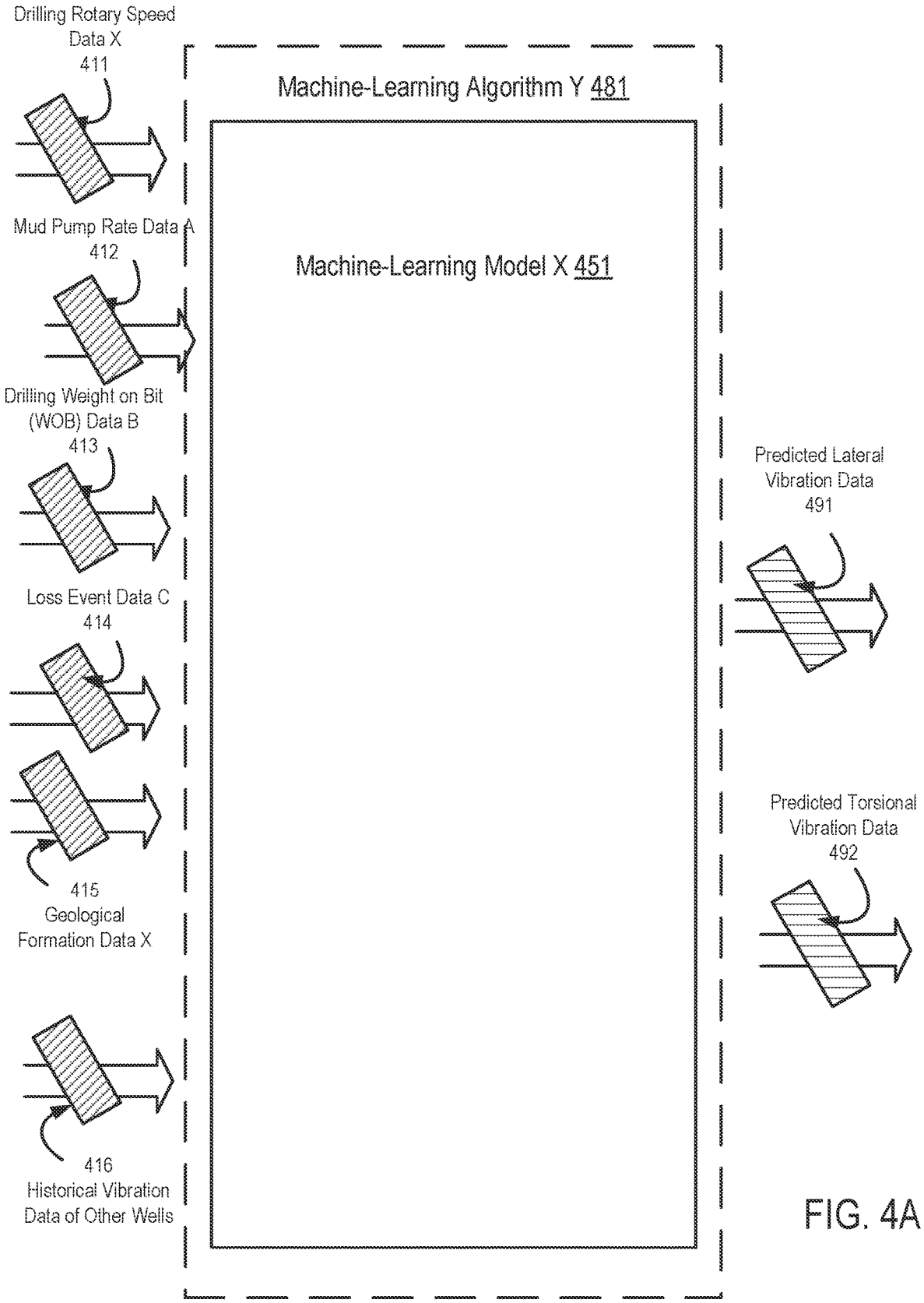
FIGS. 4A, 4B, 5, 6A, and 6B show examples in accordance with one or more embodiments.

Turning to FIG. 4A, FIG. 4A provides an example of a machine-learning model for predicting downhole vibration data in accordance with one or more embodiments. The following example is for explanatory purposes only and not intended to limit the scope of the disclosed technology. In FIG. 4A, a machine-learning model X (451) determines predicted lateral vibration data (491) and predicted torsional vibration data (492) of a drill string in a drilling operation in real-time. More specifically, the machine-learning model X (451) obtains the following inputs, i.e., drilling rotary speed data X (411), mud pump rate data A (412), drilling weight-on-bit data B (413), loss event data C (414), geological formation data X (415), and historical vibration data (416) of other wells. The machine-learning model X (451) may be trained using a machine-learning algorithm Y (481), such as a supervised learning algorithm.

Returning to FIG. 3, in Block 345, one or more predicted ROP values are determined using an ROP model, drilling surface parameter data, geological data, vibration data, loss event data, and/or one or more predicted vibration values in accordance with one or more embodiments. In particular, the rate of penetration of the wellbore may be enhance while managing downhole vibrations. For example, a certain time and depth in a drilling operation may have an actual rotary speed value, an actual mud pump rate (e.g., in gallons per minute (GPM)), and an actual weight-on-bit value with one or more actual ROP vales from one or more previous drilled sections in the wellbore. Assuming a drilling operation is performed in the same geological zone, the actual rotary speed value, the actual mud pump rate, the actual weight-on-bit value, the one or more previous ROP values, and any predicted downhole vibration data may be used by an ROP model to predict an ROP value of the drill string. Thus, an ROP model may be coupled to a machine-learning model that predicts downhole vibrations.

Figure 4B:
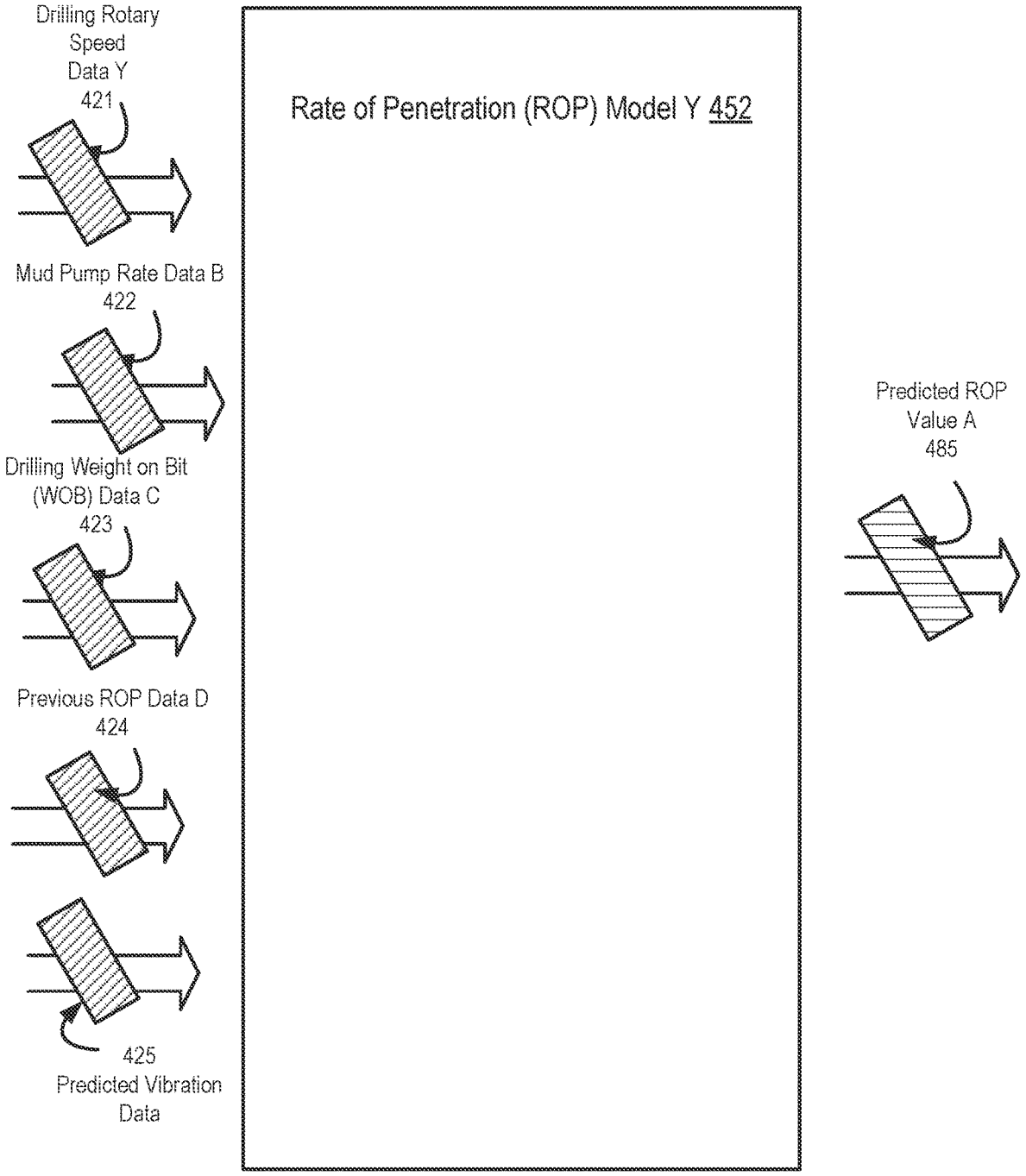

Turning to FIG. 4B, FIG. 4B provides an example of an ROP model in accordance with one or more embodiments. The following example is for explanatory purposes only and not intended to limit the scope of the disclosed technology. In FIG. 4B, an ROP model Y (452) determines a predicted ROP value A (485) using the following inputs, i.e., drilling rotary speed data Y (421), mud pump rate data B (422), drilling weight-on-bit data C (423), previous ROP data D (424), and predicted vibration data (425) for a real-time drilling operation. The ROP model Y (452) may be a machine-learning model that is trained using a machine-learning algorithm, such as a supervised learning algorithm, or a linear model that determines predicted ROB values based on specific drilling surface parameters and/or predicted vibration data.

Returning to FIG. 3, in Block 350, one or more predicted vibration values and/or one or more predicted ROP values are presented in accordance with one or more embodiments. The predicted values of ROP and downhole vibrations may be sorted from the highest to lowest (e.g., if the user intends to maximize the ROP of the drilling operation) or ROP values may be sorted from the lowest to the highest (e.g., if the user is intended to minimize the severity of vibration) for selection. The user may decide on a particular presentation within a display device based on his/her experience and his/her assessment of the downhole conditions.

Furthermore, different combinations of rotary speed, mud pump rate, and/or weight-on-bit with the corresponding predicted ROB value may be presented with respect to a current combination of drilling surface parameters and predicted downhole vibration data in the user device. For example, different combinations of parameters may be determined using a clustering algorithm. The clustering algorithm may be an unsupervised machine learning clustering algorithm, such as a K-mean algorithm or a density-based spatial clustering algorithm with application with noise (i.e., a DBSCAN algorithm). Using the user device, a user may select the best cluster that leads to an optimum ROP value and lower downhole vibrations.

Furthermore, the top five parameter combinations (or other predetermined number of combinations) may be displayed on a user device to a user. The user may thus select a drilling parameter cluster with a desired ROP and a desired vibration severity (e.g., the highest ROP with lowest vibration severity). In some embodiments, an automated drilling manager may send a recommendation to a user device based on predicted vibration data and/or predicted ROP data. Likewise, an automated drilling manager may also select the predicted ROB value is an optimum downhole vibration without input from a human user. Table 1 below provides an example of different drilling parameter combinations along with various predicted ROP values and predicted vibration data:

TABLE 1

| Combination | Explored Drilling Parameter Combination | | | | Predicted Outcomes |
|---|---|---|---|---|---|
| 1 | RPM = 122 | GPM = 810 | WOB = 27,000 | ROP = 30 ft/hr | Lateral Risk = 0, Torsional Risk = 1 |
| 2 | RPM = 117 | GPM = 800 | WOB = 26,000 | ROP = 35 ft/hr | Lateral Risk = 2, Torsional Risk = 1 |
| 3 | RPM = 125 | GPM = 820 | WOB = 24,000 | ROP = 40 ft/hr | Lateral Risk = 1, Torsional Risk = 2 |
| 4 | RPM = 130 | GPM = 830 | WOB = 23,000 | ROP = 42 ft/hr | Lateral Risk = 2, Torsional Risk = 2 |
| 5 | RPM = 132 | GPM = 800 | WOB = 28,000 | ROP = 23 ft/hr | Lateral Risk = 2, Torsional Risk = 1 |

Figure 5:
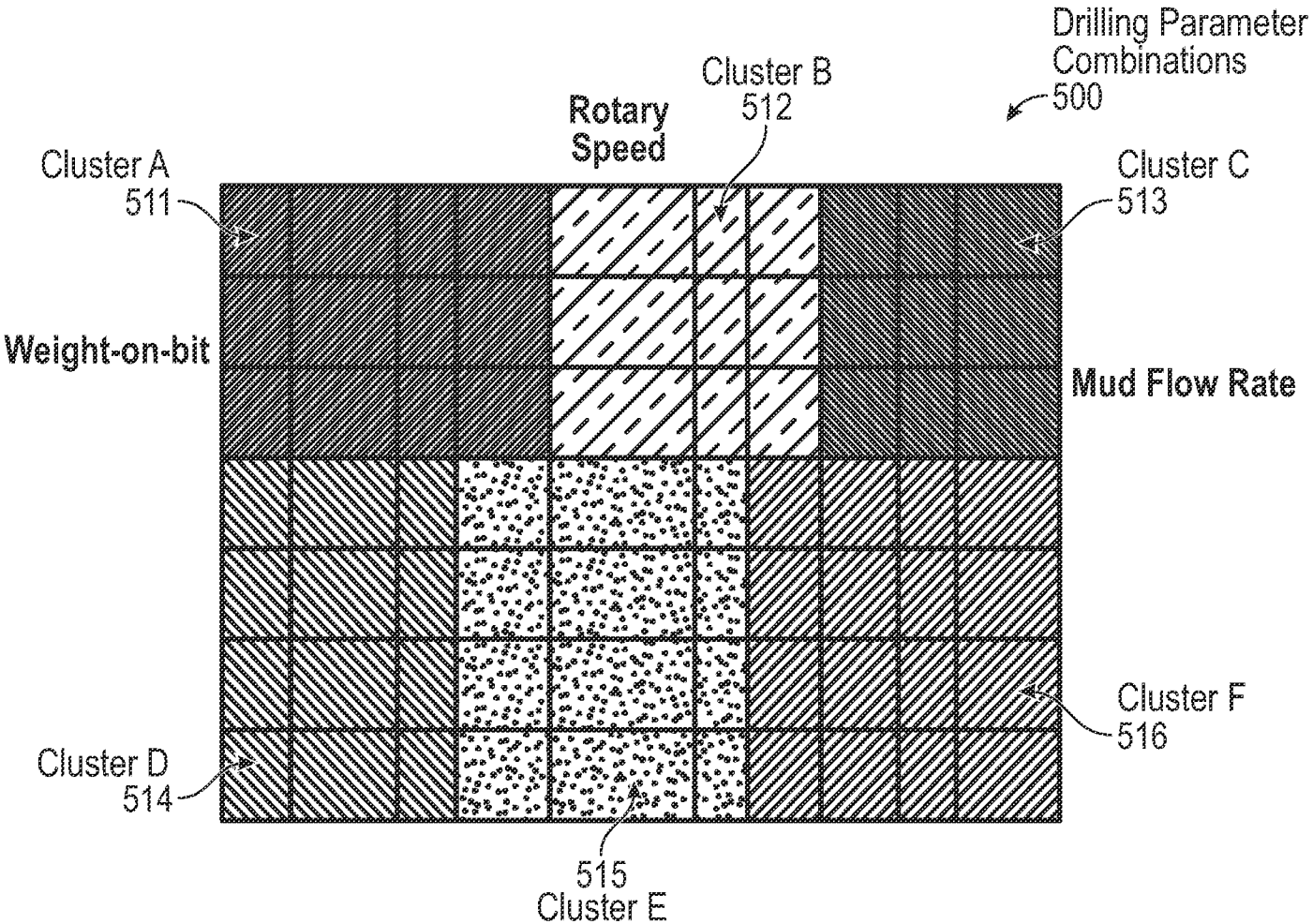

Turning to FIG. 5, FIG. 5 provides an example of presenting multiple drilling parameter combinations in association with various drilling surface parameters in accordance with one or more embodiments. The following example is for explanatory purposes only and not intended to limit the scope of the disclosed technology. In FIG. 5, different combinations of drilling parameters (500) are shown. In particular, FIG. 5 includes different axes that correspond to rotary speed, mud pump rate, and weight-on-bit where small incremental changes around the current drilling parameter combination affect predicted ROP values and predicted downhole vibrations. As such, FIG. 5 illustrates various clusters (i.e., cluster A (511), cluster B (512), cluster C (513), cluster D (514), cluster E (515), cluster F (516)) that are produced with a clustering algorithm. Each cluster may include different combinations of drilling parameters (e.g., rotary speed (RS), weight-on-bit (WOB), mud pump rate (Q)) along with their predicted ROP and downhole vibrations. For example, a predetermined number of the best drilling parameter combinations (e.g., the top five drilling parameter combinations) may be displayed to the user. The user may select a particular cluster with the best ROP and lowest downhole vibration severity.

Returning to FIG. 3, in Block 355, an adjusted ROP value is determined based on one or more predicted vibration values, one or more predicted ROP values, and an ROP value of a drill string in accordance with one or more embodiments. Based on a predicted ROP value and a downhole vibration severity level, for example, a user may select a drilling parameter combination to implement in the next section of a wellbore path.

In Block 360, one or more commands are transmitted to implement an adjusted ROP value of a drill string in a drilling operation in accordance with one or more embodiments. For example, commands may be transmitted to various control system to adjust ROP values and/or other drilling parameters based on predicted downhole vibration data. Likewise, a user or an automated drilling manager may select different drilling parameter combinations to achieve a desired drilling operation, such as to reduce lost circulation events.

Figure 6A:
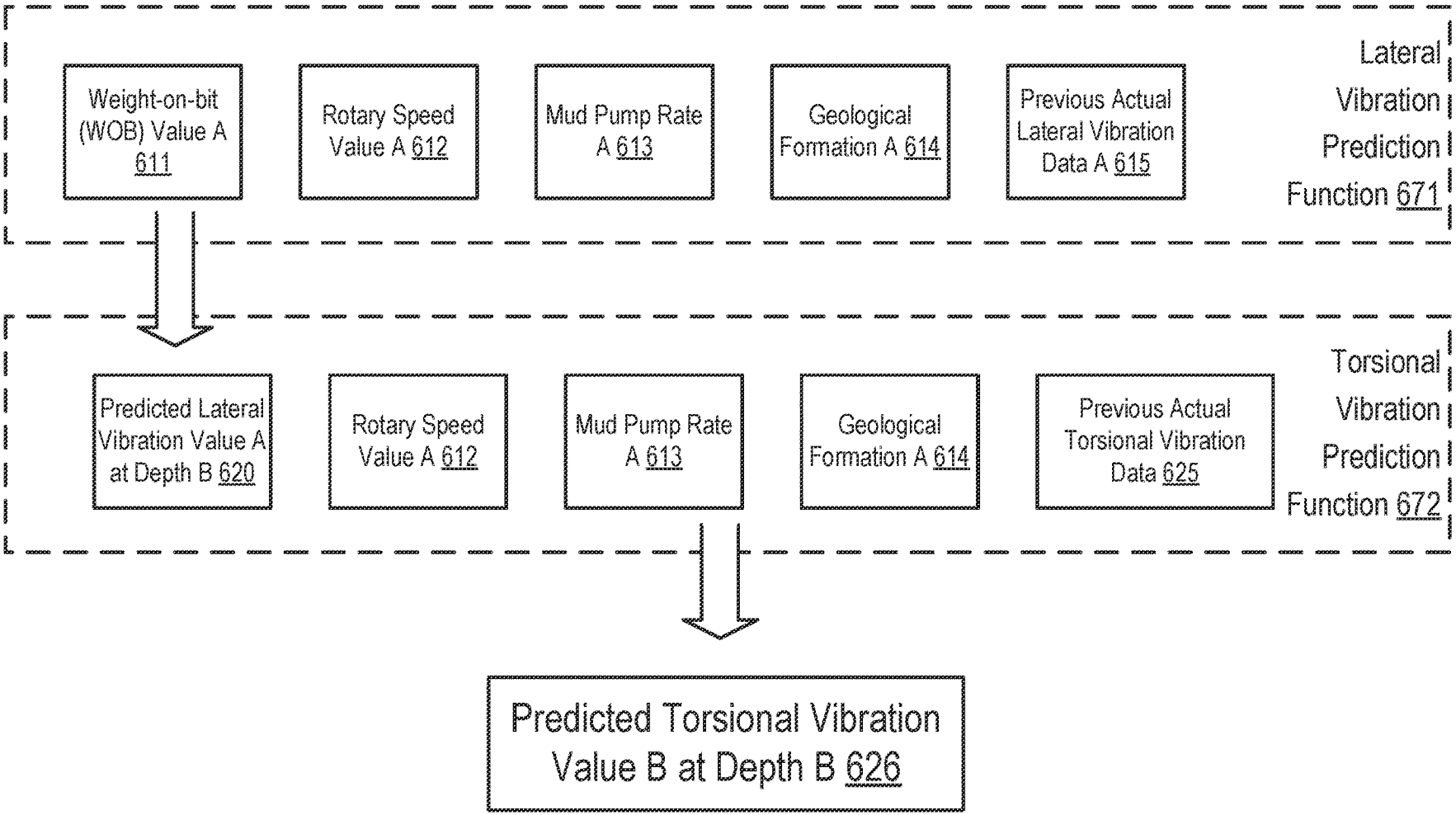
Figure 6B:
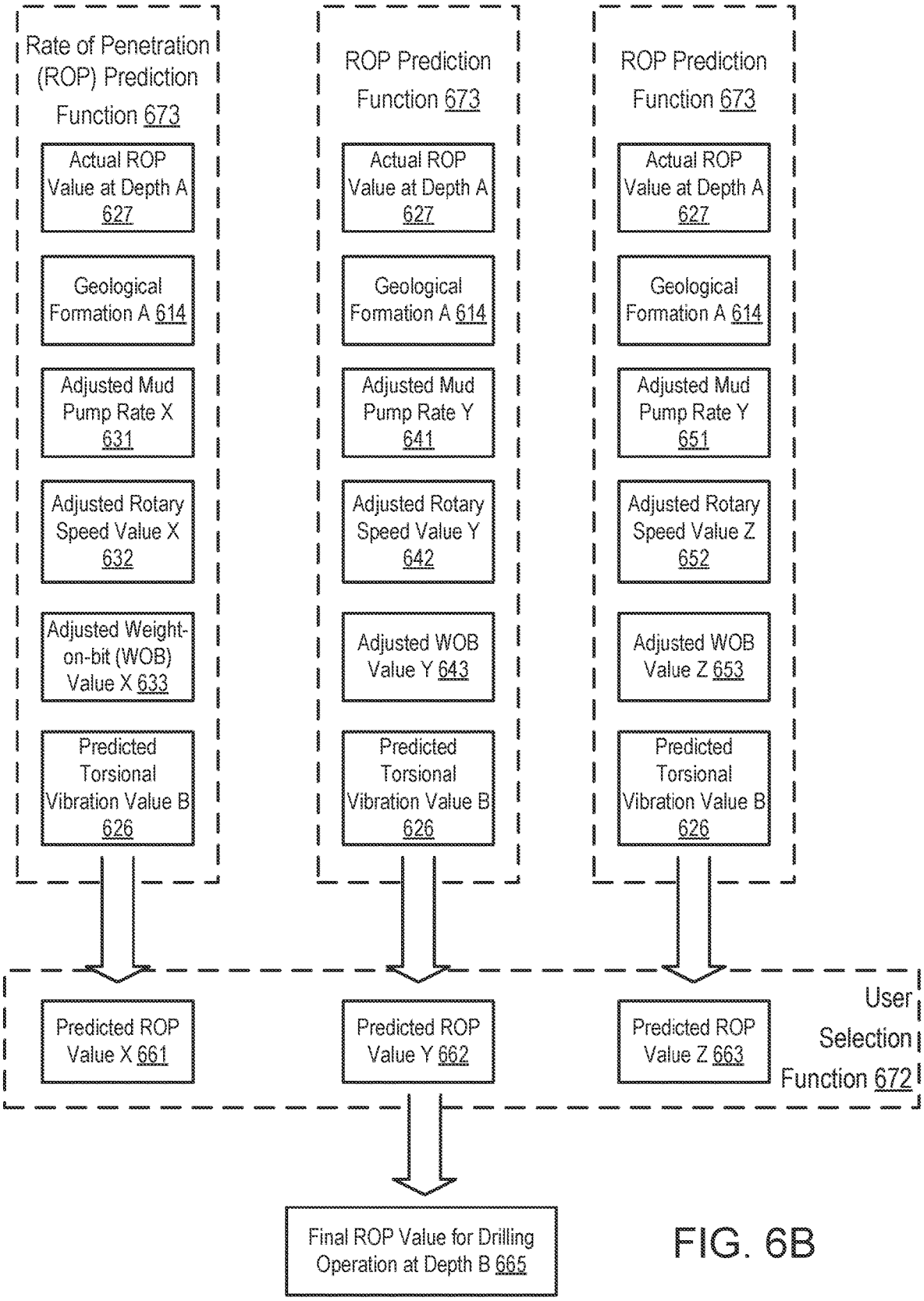

FIGS. 6A and 6B illustrate an example for determining an optimized ROP values based on predicting lateral and torsional vibration data in accordance with one or more embodiments. The following example is for explanatory purposes only and not intended to limit the scope of the disclosed technology. In FIG. 6A, an automated drilling manager (not shown) determines obtains various drilling surface parameter data (i.e., weight-on-bit (WOB) value A (611), rotary speed value A (612), mud pump rate A (613)), geological data of the current depth of a drilling operation (i.e., geological formation A (614)), and previous actual lateral vibration data (615). Using the drilling surface parameter data, the geological data, and the vibration data (615) as inputs, the automated drilling manager applies a lateral vibration prediction function (671) using a linear regression model to determine a predicted lateral vibration value A (620) for depth B of a wellbore. Next, the automated drilling manager uses the predicted lateral vibration value A (620), the rotary speed A (612), the mud pump rate A (613), geological data identifying the depth B being at geological formation A (614), and previous actual torsional vibration data (625) as inputs to a torsional vibration prediction function (672) that uses another linear regression model. The torsional vibration prediction function (672) then outputs the predicted torsional vibration value B (626) for depth B in the wellbore.

Turning to FIG. 6B, the automated drilling manager user a rate of penetration (ROP) prediction function (673) to predict multiple ROP values for different combinations of drilling surface parameters based on predicted vibration data (i.e., torsional vibration prediction function (672)). Initially, the automated drilling manager obtains the actual ROP value at the previous depth interval of the drilled wellbore (i.e., actual ROP value (627) at depth A) and determines the same geological formation applies (i.e., geological formation A (614)). The automated drilling manager than analyzes different combinations of drilling surface parameters, such as a combination with an adjusted mud pump rate X (631), adjusted rotary speed value X (632), an adjusted WOB value X (633), another combination with an adjusted mud pump rate Y (641), adjusted rotary speed value Y (642), an adjusted WOB value Y (643), and another combination with an adjusted mud pump rate Z (651), adjusted rotary speed value X (652), an adjusted WOB value X (653). Using the predicted torsional vibration value B (626) from FIG. 6A, the automated drilling manager determines a predicted ROP value X (661), a predicted ROP value Y (662), and a predicted ROP value Z (663) for each drilling parameter combination. Afterwards, the predicted ROP values (661, 662, 663) and their different drilling parameter values are presented on a user device (not shown), where a user selects a desired ROP value and combination (i.e., using a user selection function (672) that is implemented using a graphical user interface). Accordingly, a user selection determines a final ROP value (665) for a drilling operation at depth B. The automated drilling manager then transmits a command to a control system in a drilling system that implements the combination of drilling parameters and the final ROP value (665) accordingly.

Figure 7:
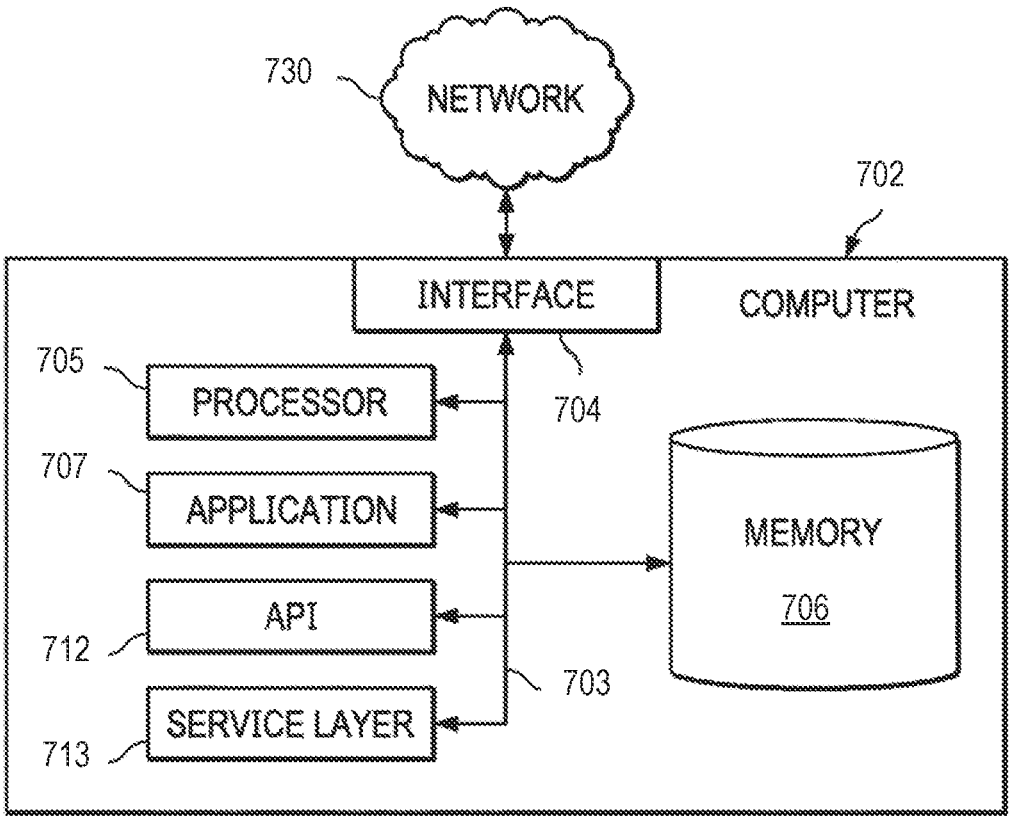
FIG. 7 shows a computer system in accordance with one or more embodiments.

Embodiments may be implemented on a computer system. FIG. 7 is a block diagram of a computer system (702) used to provide computational functionalities associated with described algorithms, methods, functions, processes, flows, and procedures as described in the instant disclosure, according to an implementation. The illustrated computer (702) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730) or cloud. In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) or cloud from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704 includes logic encoded in software or hardware (or a combination of software and hardware) and operable to communicate with the network (730) or cloud. More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

In some embodiments, the computer (702) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), artificial intelligence as a service (AIaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining first drilling surface parameter data regarding a plurality of drilling parameters during a first drilling operation for a first wellbore, wherein the first drilling surface parameter data comprises drilling rotary speed data, first mud pump rate data, and drilling weight-on-bit data that are being used in the first drilling operation;

obtaining first geological data regarding a geological formation within a subsurface of the first wellbore that is being drilled during the first drilling operation;

obtaining first historical vibration data regarding one or more drilling operations for one or more wellbores;

obtaining loss event data regarding one or more lost circulation events from the first wellbore;

determining, by a computer processor, first predicted vibration data for a bottomhole assembly in the first drilling operation using a first machine-learning model, the first drilling surface parameter data, the first geological data, the first historical vibration data, and a first rate of penetration (ROP) value regarding the bottomhole assembly, wherein the first predicted vibration data comprises predicted lateral vibration data and predicted torsional vibration data, wherein the first machine-learning model is a first artificial neural network comprising a first input layer, a first plurality of hidden layers, and a first output layer, and wherein the first drilling surface parameter data, the loss event data, the first geological data, and the first historical vibration data are inputs to the first input layer of the first artificial neural network, and wherein the predicted lateral vibration data and the predicted torsional vibration data are outputs from the first output layer of the first artificial neural network;

determining, by the computer processor, a predicted ROP value regarding the bottomhole assembly using the first predicted vibration data, a second machine-learning model, and the first ROP value, wherein the second machine-learning model is a second artificial neural network comprising a second input layer, a second plurality of hidden layers, and a second output layer, wherein the first predicted vibration data, the first drilling surface parameter data, and the first ROP value are inputs to the second input layer of the second artificial neural network, and wherein the predicted ROP value is an output from the second output layer of the second artificial neural network;

determining, by the computer processor, a plurality of drilling parameter clusters using the predicted ROP value, the first predicted vibration data, a plurality of drilling parameter combinations, and a clustering algorithm, wherein the plurality of drilling parameter combinations comprises the first drilling surface parameter data, wherein the first drilling surface parameter data corresponds to a current combination of drilling parameters being used in the first drilling operation;

presenting, by the computer processor, the plurality of drilling parameter clusters in a graphical user interface on a user device;

determining, by the computer processor, an adjusted mud pump rate based on a selected cluster among the plurality of drilling parameter clusters, wherein the selected cluster corresponds to a user selection within the graphical user interface in response to presenting the plurality of drilling parameter clusters; and transmitting a first command to a mud pump system to update the first drilling operation based on the adjusted mud pump rate, wherein the mud pump system supplies a first drilling fluid to the first wellbore at the adjusted mud pump rate.

2. The method of claim 1, wherein the second machine-learning model determines the predicted ROP value based on a plurality of inputs for a first section of a wellbore in the first drilling operation, wherein the plurality of inputs comprise a second ROP value, and wherein the second ROP value corresponds to a second section of the wellbore that was drilled prior to drilling the first section of the wellbore.

3. The method of claim 1, wherein the first historical vibration data corresponds to a vibration type selected from a group consisting of a lateral vibration, a torsional vibration, and an axial vibration of a bottomhole assembly.

4. The method of claim 1, wherein the first machine-learning model uses second predicted vibration data that is determined by the first machine-learning model at an earlier time than the first predicted vibration data in the first drilling operation to determine the first predicted vibration data.

5. The method of claim 1, further comprising:

acquiring the first historical vibration data from a second wellbore using a plurality of downhole pressure sensors coupled to a drill string, wherein the first drilling operation is performed in the first wellbore using the bottomhole assembly that does not include a downhole pressure sensor for detecting vibrations.

6. The method of claim 1, further comprising:

obtaining a training dataset comprising second drilling surface parameter data, second geological data, second vibration data, and ROP data from a plurality of drilling operations for a plurality of wells;

obtaining an initial model; and updating the initial model using the training dataset and a plurality of machine-learning epochs to produce a trained model, wherein the trained model is the first machine-learning model.

7. The method of claim 1, further comprising:

obtaining, by a user device, the first predicted vibration data of the bottomhole assembly;

presenting, on a display device coupled to the user device, a plurality of adjusted ROP values associated with the first predicted vibration data;

obtaining, by the user device, a user selection of the plurality of adjusted ROP values; and the transmitting a second command to produce an adjusted ROP value correspond to the user selection.

8. A system, comprising:

a first drilling system comprising a bottomhole assembly that comprises a first drill string, wherein the first drilling system is coupled to a first wellbore;

a mud pump system coupled to the first wellbore; and a control system coupled to the first drilling system and the mud pump system, wherein the control system comprises a computer processor, the control system being configured to perform a method comprising:

obtaining first drilling surface parameter data regarding a plurality of drilling parameters during a first drilling operation for the first wellbore, wherein the first drilling surface parameter data comprises drilling rotary speed data, first mud pump rate data from the mud pump system, and drilling weight-on-bit data that are being used in the first drilling operation;

obtaining first geological data regarding a geological formation within a subsurface of the first wellbore that is being drilled during the first drilling operation;

obtaining first historical vibration data regarding one or more drilling operations for one or more wellbores;

obtaining loss event data regarding one or more lost circulation events from the first wellbore;

determining first predicted vibration data for the bottomhole assembly in the first drilling operation using a first machine-learning model, the first drilling surface parameter data, the geological formation being drilled, the first historical vibration data, and a first rate of penetration (ROP) value regarding the bottomhole assembly, wherein the first predicted vibration data comprises predicted lateral vibration data and predicted torsional vibration data, wherein the first machine-learning model is a first artificial neural network comprising a first input layer, a first plurality of hidden layers, and a first output layer, and wherein the first drilling surface parameter data, the loss event data, the first geological data, and the first historical vibration data are inputs to the first input layer of the first artificial neural network, and wherein the predicted lateral vibration data and the predicted torsional vibration data are outputs from the first output layer of the first artificial neural network;

determining a predicted ROP value regarding the bottomhole assembly using the first predicted vibration data, a second machine-learning model, and the first ROP value, wherein the second machine-learning model is a second artificial neural network comprising a second input layer, a second plurality of hidden layers, and a second output layer, wherein the first predicted vibration data, the first drilling surface parameter data, and the first ROP value are inputs to the second input layer of the second artificial neural network, and wherein the predicted ROP value is an output from the second output layer of the second artificial neural network;

determining a plurality of drilling parameter clusters using the predicted ROP value, the first predicted vibration data, a plurality of drilling parameter combinations, and a clustering algorithm, wherein the plurality of drilling parameter combinations comprises the first drilling surface parameter data, wherein the first drilling surface parameter data corresponds to a current combination of drilling parameters being used in the first drilling operation;

presenting the plurality of drilling parameter clusters in a graphical user interface on a user device;

determining an adjusted mud pump rate based on a selected cluster among the plurality of drilling parameter clusters, wherein the selected cluster corresponds to a user selection within the graphical user interface in response to presenting the plurality of drilling parameter clusters; and transmitting a first command to the mud pump system to update the first drilling operation based on the adjusted mud pump rate, wherein the mud pump system is configured to supply a first drilling fluid to the first wellbore at the adjusted mud pump rate.

9. The system of claim 8, further comprising:

a user device coupled to the control system, wherein the user device is configured to provide the graphical user interface for presenting a plurality of predicted ROP values for a drilling operation, wherein the method further comprises transmitting a second command to produce an adjusted ROP value, and wherein the adjusted ROP value corresponds to a user selection that is obtained from a user using the user device.

10. The system of claim 8, wherein the second machine-learning model determines the predicted ROP value based on a plurality of inputs for a first section of a wellbore in the first drilling operation, wherein the plurality of inputs comprise a second ROP value, and wherein the second ROP value corresponds to a second section of the first wellbore that was drilling prior to drilling the first section of the first wellbore.

11. The system of claim 8, wherein the first machine-learning model uses second predicted vibration data that is determined by the first machine-learning model at an earlier time than the first predicted vibration data in the first drilling operation to determine the first predicted vibration data.

12. The system of claim 8, wherein the first historical vibration data is acquired from a second wellbore using a plurality of downhole pressure sensors coupled to a second drilling system that is separate from the first drilling system, and wherein the first drilling operation is performed in the first wellbore using the bottomhole assembly that does not include a downhole pressure sensor for detecting vibrations of the first drill string.

13. The system of claim 8, wherein the control system is further configured to:

obtain a training dataset comprising second drilling surface parameter data, second geological data, second vibration data, and ROP data from a plurality of drilling operations for a plurality of wells;

obtain an initial model; and update the initial model using the training dataset and a plurality of machine-learning epochs to produce a trained model, wherein the trained model is the first machine-learning model.

* * * * *